US008305272B2

(12) United States Patent
Chiang

(10) Patent No.: US 8,305,272 B2
(45) Date of Patent: Nov. 6, 2012

(54) MULTI-BAND ANTENNA STRUCTURE

(75) Inventor: Chi-Ming Chiang, Bade (TW)

(73) Assignee: Auden Techno Corp., Taoyuan County (TW)

( * ) Notice: Subject to any disclaimer, the term of this patent is extended or adjusted under 35 U.S.C. 154(b) by 301 days.

(21) Appl. No.: 12/832,401

(22) Filed: Jul. 8, 2010

(65) Prior Publication Data

US 2012/0007780 A1 Jan. 12, 2012

(51) Int. Cl.
*H01Q 1/32* (2006.01)

(52) U.S. Cl. ..... 343/700 MS

(58) Field of Classification Search ..... 343/700 MS, 343/745, 702, 846, 895, 767
See application file for complete search history.

(56) References Cited

U.S. PATENT DOCUMENTS 7,602,343 B2 * 10/2009 Takada et al. ..... 343/702
7,911,387 B2 * 3/2011 Hill et al. ..... 343/700 MS
8,013,796 B2 * 9/2011 Liu et al. ..... 343/702
8,054,229 B2 * 11/2011 Kaneoya ..... 343/702
8,085,208 B2 * 12/2011 Wallace ..... 343/749
2004/0257283 A1 * 12/2004 Asano et al. ..... 343/702
2008/0048799 A1 * 2/2008 Wang et al. ..... 333/156

* cited by examiner

*Primary Examiner* — Huedung Mancuso

(74) *Attorney, Agent, or Firm* — Houtteman Law LLC

(57) ABSTRACT

A multi-band antenna structure includes a substrate having a first surface and a second surface that is opposite to the first surface, a first metal strip and a second metal strip formed on the first surface, a third metal strip formed on the second surface, and a metal part located on the substrate. The first metal strip has a first strip and a second strip and the second strip has an inductance characteristic. The first strip of the first metal strip and the third metal strip define a first overlap area in the direction vertical to the substrate. The first overlap area has a first capacitor characteristic. The second metal strip and the third metal strip define a second overlap area in the direction vertical to the substrate. The second overlap area has a second capacitor characteristic.

10 Claims, 2 Drawing Sheets

MULTI-BAND ANTENNA STRUCTURE

BACKGROUND OF THE INVENTION

1. Field of the Invention

The present invention relates to a multi-band antenna structure. In particular, the present invention relates to a multi-band antenna structure that uses metal strip to replace the LC elements.

2. Description of Related Art

As wireless communication has been progressed, the wireless transmission technology is popularly applied to the mobile information medium or personal data manage tools. For example, the electronic devices (such as lap lop) has a data transmission function to other data devices. The wireless transmission way with antenna can simplifies the setting process. Furthermore, it is convenient for the user to receive data or information without limitation of space.

LTE is long-term evolution and is a new mobile wireless wide band technology. The LTE technology makes the service provider to provide the wireless wide band service in a cheaper way. The LTE is treated as a new wireless standard technology by the third generation partnership project (3GPP). LTE can have a good performance for wireless wide band data and is compatible to the network of the GSM service provider. In other words, no matter the service provider has built up the general mobile communication system, the service provider also can built up the service that uses the LTE technology.

In the traditional LTE antenna, the substrate has a plurality of LC elements, such as two capacitors and one inductor. However, the LC elements must be disposed on the specific location of the substrate by a manufacturing process. Therefore, the manufacturing process of the traditional antenna is complex and the manufacturing cost is high.

SUMMARY OF THE INVENTION

One particular aspect of the present invention is to provide a multi-band structure that uses the metal strip on the two sides of the substrate to replace the LC elements of the traditional antenna. The manufacturing process can be simplified.

Another particular aspect of the present invention is to provide a multi-band antenna structure with an improved antenna performance, such as gain and antenna efficiency can meet the requirements of the devices.

The multi-band antenna structure includes a substrate having a first surface and a second surface that is opposite to the first surface, a first metal strip and a second metal strip formed on the first surface, a third metal strip formed on the second surface, and a metal part located on the substrate. The first metal strip has a first strip and a second strip and the second strip has an inductance characteristic. The first strip of the first metal strip and the third metal strip form a first overlap area in the direction that is vertical to the substrate. The first overlap area has a first capacitor characteristic. The second metal strip and the third metal strip form a second overlap area in the direction that is vertical to the substrate. The second overlap area has a second capacitor characteristic.

In one embodiment, the inductance characteristic of the second strip can replace one inductor element, and first capacitor characteristic of the first overlap area and the second capacitor characteristic of the second overlap area can replace the two capacitors of the traditional antenna. Thereby, the antenna does not need the LC elements. The manufacturing cost of the antenna is reduced.

The present invention has the following characteristics. The present invention utilizes the metal strip located at two sides of the substrate to form the specific capacitor characteristic or the inductor characteristic to replace the LC elements. Therefore, the antenna of the present invention does not need the LC elements. The manufacturing process can be simplified, and the antenna of the present invention also meets the requirements of the product specification.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

Figure 1A:
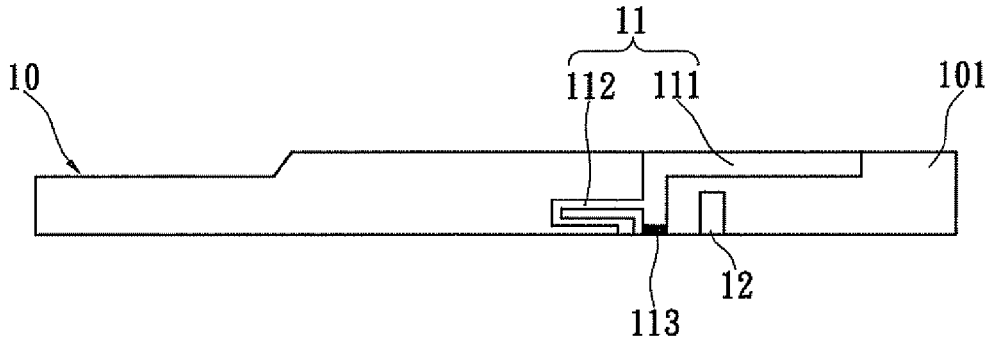
FIG. 1A is a schematic diagram of the first surface of the substrate of the multi-band antenna structure of the present invention.

The present invention provides a multi-band antenna structure that uses the metal strip located at two sides of the substrate to replace the LC elements of the traditional antenna. Therefore, the band width and the antenna efficiency of the multi-band antenna structure is better than the traditional antenna. The manufacturing cost is also reduced.

Reference is made to FIGS. 1A-1C and 2A-2B, the multi-band antenna structure may be an LTE (long-term evolution) antenna which includes a substrate 10, a first metal strip 11, a second metal strip 12, a third metal strip 13, and a metal part 14.

In one embodiment, the thickness of the substrate 10 is 0.4 mm. The substrate 10 has a first surface 101 and a second surface 102 that is opposite to the first surface 101. The metal part 14 is vertically installed on the substrate 10, and the metal part 14 is surrounded around the edge of the substrate 10 and has a grounding function or a signal-receiving function.

Reference is made to FIG. 1A. The first surface 101 of the substrate 10 forms a first metal strip 11. The first metal strip 11 is composed of a first strip 111 and a second strip 112. In one embodiment, the first strip 111 is L-shaped. One end of the second strip 112 is connected with the short side of the L-shaped first strip 111. The second wire 112 extends along the first surface 101 so that another end of the second strip 112 is connected to the edge of the substrate 10 to connect the metal part 14 to form a grounding reference. For example, another end of the second strip 112 is connected with the metal part 14 via a welding point W to form the grounding. The second strip 112 has an inductance characteristic. Therefore, the length of the second strip 112 is adjusted to meet a specific inductance value. In this embodiment, the second wire 112 extends with a specific length and its end is connected with the grounding so that its inductance value is 10 nH.

The open end of the short side of the L-shaped first strip 111 is a signal input point 113, and is connected with a center conduct body 151 of a coaxial cable 15. The second strip 112 extends from the signal input point 113.

The first surface 101 of the substrate 10 forms a second metal strip 12. In this embodiment, one end of the second metal strip 12 is connected with the outer layer conduct body 152 of the coaxial cable 15 and the metal part 14. For example, a welding point W is used for connecting one end of the second metal strip 12 to the outer layer conduct body 152 of the coaxial cable 15 and the metal part 14.

Figure 1B:
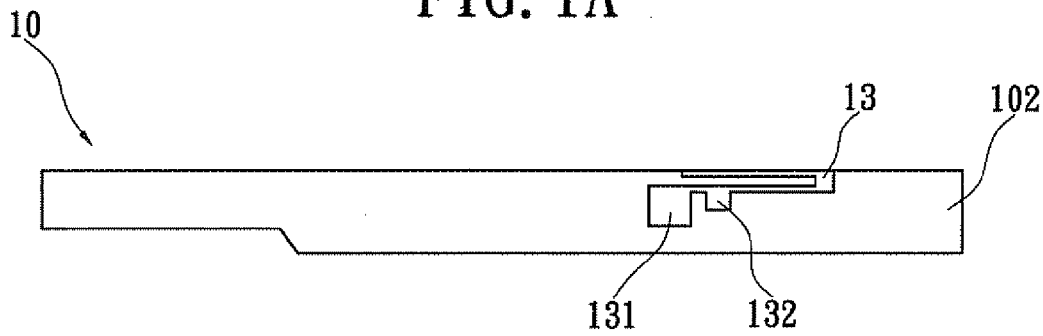
FIG. 1B is a schematic diagram of the first surface of the substrate of the multi-band antenna structure of the present invention.
Figure 1C:
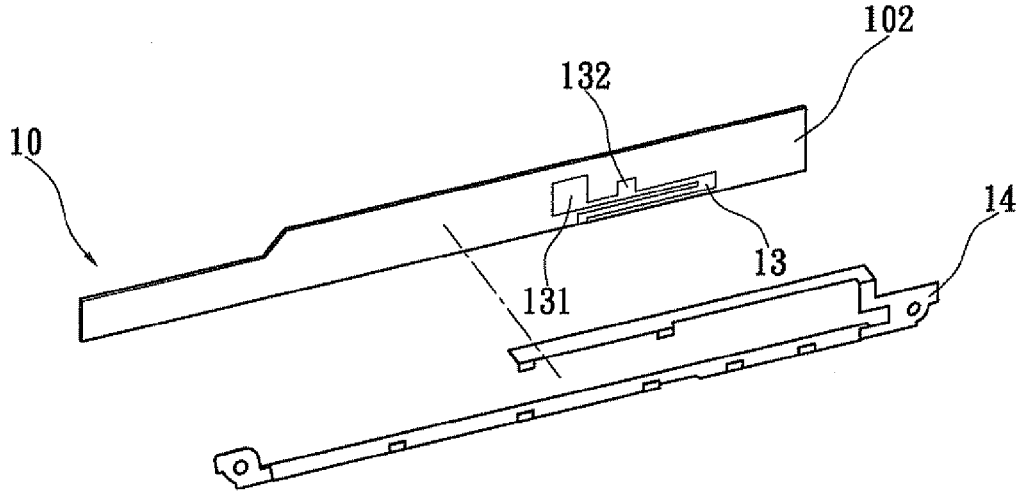
FIG. 1C is an exploded perspective view of the multi-band antenna structure of the present invention.
Figure 2A:
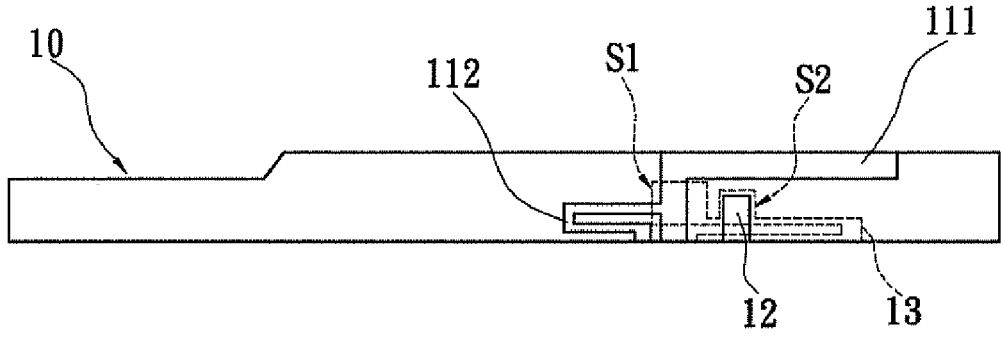
FIG. 2A is a schematic diagram of the first metal strip, the second metal strip and the third metal strip of the present invention.
Figure 2B:
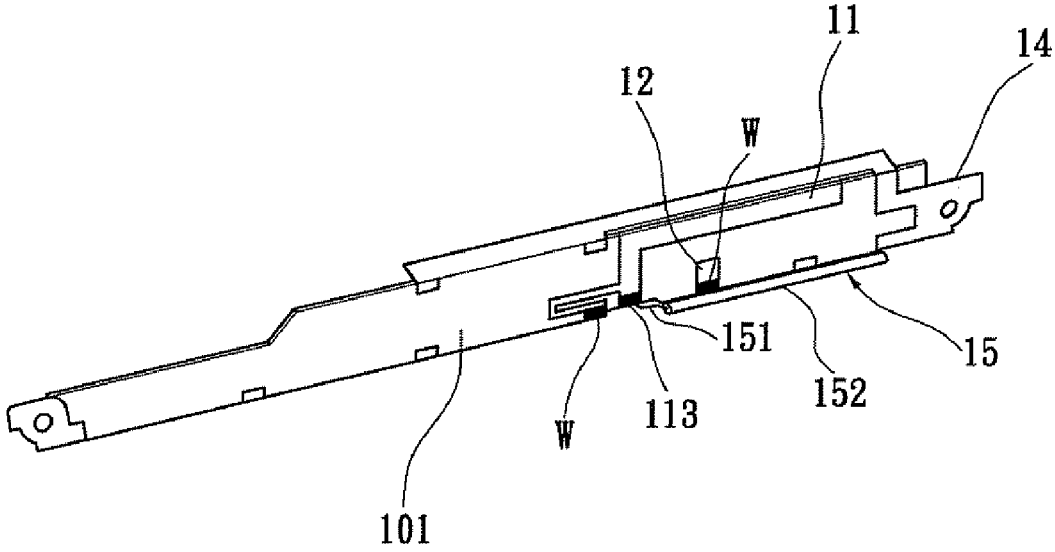
FIG. 2B is a perspective view of the multi-band antenna structure of the present invention.

Reference is made to FIGS. 1B and 2A. The second surface 102 of the substrate 10 forms a third metal strip 13. The location of the third metal strip 13 corresponds to the first metal strip 11 and the second metal strip 12. Reference is made to FIG. 2A, the first strip 111 of the first metal strip 11 and the third metal strip 13 are overlapped to define a first overlap area S1 in the direction vertical to the substrate (be vertical to the paper surface). Because the first overlap area S1 is composed of the metal strip (the first strip 111 and the third metal strip 13) located at the two opposite surfaces (the first surface 101 and the second surface 102) of the substrate 10, the first overlap area S1 has a first capacitor characteristic. As one embodiment, one end of the third metal strip 13 forms a first metal area 131. The location of the first metal area 131 corresponds to the short side of the L-shaped first strip 111. Thus, this structure is used for forming the first overlap area S1, and the first overlap area S1 has a first capacitor characteristic. Therefore, a specific capacitance value is achieved by adjusting the area of the first overlap area S1, such as adjusting the overlap area of the first metal area S1 and the short side of the L-shaped first strip 111. In this embodiment, the first overlap area S1 has 1.5 pF capacitance valve.

Similar with the above-mentioned structure, the second metal strip 12 and the third metal strip 13 are overlapped to define a second overlap area S2 in the direction vertical to substrate (be vertical to the paper surface). The second overlap area S2 is formed by the metal strip (the second metal strip 12 and the third metal strip 13) located at the two opposite surfaces of the substrate 10. Thus, the second overlap area S2 has a second capacitor characteristic. In this embodiment, the third metal strip 13 forms a second metal area 132. The second metal area 132 corresponds to the second metal strip 12. By utilizing this structure, the second overlap area S2 is formed and the second overlap area S2 has the second capacitor characteristic. For example, the specific capacitor value is achieved by adjusting the overlapped area of the second metal area 132 and the second metal strip 12. In this embodiment, the second overlap area S2 has 1 pF capacitor value. The first overlap area S1 and the second overlap area S2 in FIG. 2A are used for illustrating, and not limit the scope of the present invention.

The multi-band antenna structure of the present invention directly utilizes the length and the pattern of the overlapped area of the metal strip (the first metal strip, the second metal strip and the third metal strip) formed on the substrate to form a specific inductor or capacitor characteristic. Therefore, the LC elements of the traditional antenna can be replaced. The manufacturing cost of the antenna is reduced.

The following tables show the antenna characteristic of the multi-band antenna structure. Gain value and the efficiency can meet the product specifications.

| | Frequency (MHz) | | | | | | | | | | |
|---|---|---|---|---|---|---|---|---|---|---|---|
| | 704 | 710 | 716 | 734 | 740 | 746 | 751 | 756 | 777 | 782 | 787 |
| 3D GAIN | −4.225 | −3.834 | −3.845 | −3.559 | −3.737 | −3.428 | −3.609 | −3.441 | −3.73 | −3.895 | −3.937 |
| Efficiency (%) | 37.80 | 4136 | 41.26 | 44.07 | 42.30 | 45.42 | 43.56 | 45.28 | 42.36 | 40.78 | 40.39 |

| | Frequency (MHz) | | | | | | | | | | |
|---|---|---|---|---|---|---|---|---|---|---|---|
| | 824 | 830 | 835 | 836 | 840 | 849 | 860 | 865 | 869 | 870 | 875 |
| 3D GAIN | −3.955 | −3.941 | −3.98 | −4.015 | −4.057 | −4.071 | −4.009 | −4.301 | −4.153 | −4.139 | −4.469 |
| Efficiency (%) | 40.23 | 40.36 | 39.99 | 39.67 | 39.29 | 39.17 | 39.73 | 37.14 | 38.43 | 38.56 | 35.74 |

| | Frequency (MHz) | | | | | | | | |
|---|---|---|---|---|---|---|---|---|---|
| | 880 | 885 | 894 | 900 | 915 | 920 | 925 | 940 | 960 |
| 3D GAIN | −4.314 | −4.498 | −4.696 | −4.771 | −4.668 | −4.61 | −4.397 | −5.22 | −6.335 |
| Efficiency (%) | 37.03 | 35.50 | 33.92 | 33.33 | 34.14 | 34.59 | 36.33 | 30.06 | 23.25 |

| | Frequency (MHz) | | | | | | | | | |
|---|---|---|---|---|---|---|---|---|---|---|
| | 1710 | 1750 | 1785 | 1805 | 1840 | 1850 | 1880 | 1910 | 1920 | 1930 |
| 3D GAIN | −3.89 | −2.505 | −2.274 | −2.211 | −2.087 | −2.371 | −2.654 | −2.663 | −2.64 | −2.435 |
| Efficiency (%) | 40.83 | 56.17 | 59.24 | 60.10 | 61.84 | 57.93 | 54.28 | 54.45 | 54.45 | 57.08 |

| | Frequency (MHz) | | | | | | | | | |
|---|---|---|---|---|---|---|---|---|---|---|
| | 1950 | 1960 | 1980 | 1990 | 2110 | 2140 | 2170 | 2300 | 2350 | 2400 |
| 3D GAIN | −2.569 | −2.492 | −2.473 | −2.045 | −3.459 | −4.16 | −3.778 | −3.999 | −3.504 | −2.943 |
| Efficiency (%) | 55.35 | 56.34 | 56.58 | 62.45 | 45.09 | 38.37 | 41.90 | 39.82 | 44.63 | 50.78 |

| | Frequency (MHz) | | | | | |
|---|---|---|---|---|---|---|
| | 2500 | 2535 | 2570 | 2620 | 2655 | 2690 |
| 3D GAIN | −3.686 | −3.678 | −2.97 | −3.852 | −4.151 | −3.958 |
| Efficiency (%) | 42.80 | 42.87 | 50.47 | 41.19 | 38.45 | 40.20 |

The present invention has the following characteristics.

1. The multi-band antenna structure utilizes the structure of the metal strips to provide the required capacitor and inductor characteristics to enhance the characteristic of the antenna.

2. The multi-band antenna structure does not need the LC elements. Therefore, the manufacturing cost of the antenna is reduced.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. A multi-band antenna structure, comprising:

a substrate having a first surface and a second surface opposite to the first surface;

a first metal strip and a second metal strip formed on the first surface, wherein the first metal strip has a first strip and a second strip, and the second strip has an inductance characteristic;

a third metal strip formed on the second surface, wherein the first strip of the first metal strip and the third metal strip define a first overlap area in the direction vertical to the substrate, the first overlap area has a first capacitor characteristic, the second metal strip and the third metal strip define a second overlap area in the direction vertical to the substrate, and the second overlap area has a second capacitor characteristic; and a metal part located on the substrate.

2. The multi-band antenna structure as claimed in claim 1, wherein the first strip is L-shaped, one end of the second strip is connected with a short side of the L-shaped first strip, and another end of the second wire extends to an edge of the substrate to be welded with the metal part.

3. The multi-band antenna structure as claimed in claim 2, wherein a free end of the short side of the L-shaped first strip is a signal input point, and is connected with a center conduct body of a coaxial cable.

4. The multi-band antenna structure as claimed in claim 3, wherein one end of the third metal strip forms a first metal area, the short side of the L-shaped first strip and the first metal area define the first overlap area in the direction vertical to the substrate.

5. The multi-band antenna structure as claimed in claim 4, wherein third metal strip forms a second metal area, the second metal area and the second metal strip define the second overlap area in the direction vertical to the substrate.

6. The multi-band antenna structure as claimed in claim 5, wherein one end of the second metal strip is connected with an external layer conduct body of the coaxial cable and the metal part.

7. The multi-band antenna structure as claimed in claim 1, wherein the length of the second strip is adjusted according to the inductor characteristic.

8. The multi-band antenna structure as claimed in claim 7, wherein the second strip has 10 nH inductance value.

9. The multi-band antenna structure as claimed in claim 1, wherein the area of the first overlap area is adjusted according to the first capacitor characteristic, and the second overlap area is adjusted according to the second capacitor characteristic.

10. The multi-band antenna structure as claimed in claim 9, wherein the first overlap area has 1.5 pF capacitance value, and the second overlap area has 1 pF capacitance value.

* * * * *